United States Patent [19]

Fender

[11] Patent Number: 4,686,881

[45] Date of Patent: Aug. 18, 1987

[54] ELECTROMAGNETIC PICKUP FOR STRINGED MUSICAL INSTRUMENTS

[76] Inventor: C. Leo Fender, 1510 Dana Pl., Fullerton, Calif. 92635

[21] Appl. No.: 782,114

[22] Filed: Sep. 30, 1985

[51] Int. Cl.[4] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,612,072 | 9/1952 | De Armond | 84/1.15 |
| 2,612,541 | 9/1952 | De Armond | 84/1.15 X |
| 2,909,092 | 10/1959 | De Armond et al. | 84/1.15 |
| 3,541,219 | 11/1970 | Abair | 84/1.15 |
| 3,711,619 | 1/1973 | Jones et al. | 84/1.15 |
| 3,916,751 | 11/1975 | Stich | 84/1.15 |
| 3,962,946 | 6/1976 | Rickard | 84/1.15 |
| 4,133,243 | 1/1979 | DiMarzio | 84/1.15 |
| 4,283,982 | 8/1981 | Armstrong | 84/1.15 |
| 4,499,809 | 2/1985 | Clevinger | 84/1.15 |
| 4,501,185 | 2/1985 | Blucher | 84/1.15 |

*Primary Examiner*—Stanley J. Witkowski

*Attorney, Agent, or Firm*—Spensley Horn Jubas & Lubitz

[57] ABSTRACT

An electromagnetic pickup for an electric guitar or similar stringed instrument incorporates a magnetic pickup assembly having pole pieces whose heads are slotted. The heads are positioned directly below the strings of the guitar. By orienting the slots so that they are perpendicular to the strings a percussive sound characteristic is obtained. By rotating the heads so that the slots are parallel to the strings, a sound characteristic typical of dual pole pickups is achieved.

4 Claims, 7 Drawing Figures

ELECTROMAGNETIC PICKUP FOR STRINGED MUSICAL INSTRUMENTS

BACKGROUND OF THE INVENTION

1. Field of the Invention

The present invention relates to an electromagnetic pickup for stringed musical instruments and, more particularly, to an electromagnetic pickup having alterable sound characteristics.

2. Description of the Prior Art

The present invention relates broadly to electrical musical instruments of the stringed type. It is particularly applicable to an electric guitar or a similar musical instrument having a plurality of stretched strings extending across a body and a neck in which the strings are caused to vibrate by plucking or picking them.

In order to derive an output from such an electric guitar or other similar electrical musical instrument, the instrument is conventionally provided with an electromagnetic pickup comprising a number of magnetic elements (pole pieces) having a conductive coil wound around them. Typically, one such pole piece is disposed directly beneath each string of the instrument. The strings are constructed of a magnetizable substance such as steel and therefore become part of the conductive path for the magnetic lines of flux of the pole pieces. Accordingly, when any of the strings are caused to vibrate, this causes a disturbance in the magnetic field of the associated pole pieces. This has the effect of generating a voltage in the conductive coil, which may be suitably amplified and transmitted to a loudspeaker system.

The typical string arrangement in which a pole piece is located directly beneath a string is shown in FIG. 1. This figure illustrates an electric bass guitar 10 including a pickup assembly 12 having four pole pieces 14*a–d*, with each pole piece being located directly beneath one of the strings of the guitar. This arrangement is typically referred to as a "percusive" pickup, since the resulting sound is a strong percusive sound followed by a very rapid decay or attenuation to a much lower sound level.

A second type of pickup is illustrated in FIG. 2. In this guitar, a pair of pole pieces 16 are provided for each string, with the string being located between the pole pieces. Alternatively, the pickup may be provided with one more pole piece than the number of strings and positioned such that each string lies between two adjacent pole pieces. Such an arrangement is disclosed in U.S. Pat. No. 2,968,204, issued on Jan. 17, 1961, to the same inventor as the present application. Such an arrangement is typcially referred to as a dual pole pickup. This type of pickup typically produces a sound which does not have an initial extreme percusive effect and which is more sustained.

It can be appreciated that in certain situations it is desirable to provide a percusive-type sound while in other instances it is desirable to provide a dual pole-type sound. In the past, this has required two different guitars, one each being provided with the desired pickup configuration.

SUMMARY OF THE INVENTION

The present invention eliminates the necessity of choosing a guitar having either a percussive or dual pole pickup by providing a pickup whose characteristics are alterable to achieve either type of sound. This is accomplished by providing a pickup assembly having a number of pole pieces which is equal to the number of strings and in which the pole pieces are positioned directly beneath the strings. Each pole piece has a slotted head and is rotatable from a first position in which the slots are perpendicular to the strings and a second position in which the slots are parallel to the strings. When in the first position, the pole pieces operate in a normal fashion, i.e., as they would if there were no slot, and therefore provide a percussive-type sound. When in the second position, however, each pole piece operates as if it were two separate pole pieces due to the presence of the slot. Since the two portions of the head are positioned to either side of the string in this orientation, they operate essentially as a dual pole pickup. Thus, simply by rotating the pole pieces, one can achieve either percussive or dual pole sound characteristics.

BRIEF DESCRIPTION OF THE DRAWINGS

The invention will be described with reference to the accompanying drawings wherein.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by reference to the accompanying claims.

Figure 3:
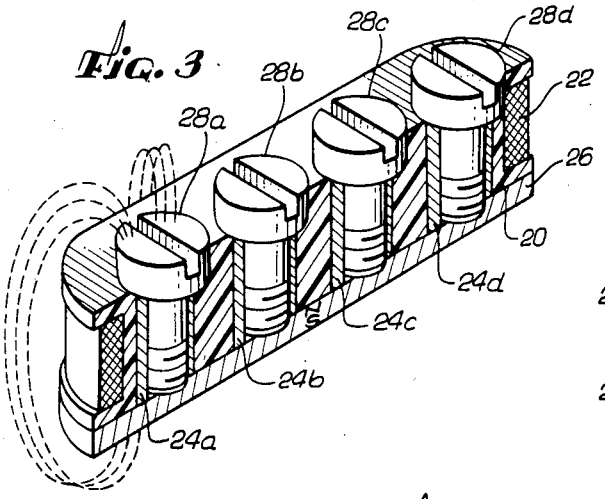
FIG. 3 is a perspective view in section of a pickup according to the present invention.
Figure 5:
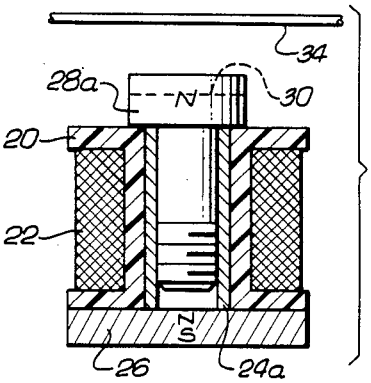
FIG. 5 is a sectional view of the pickup taken along line 5—5 of FIG. 4.
Figure 4:
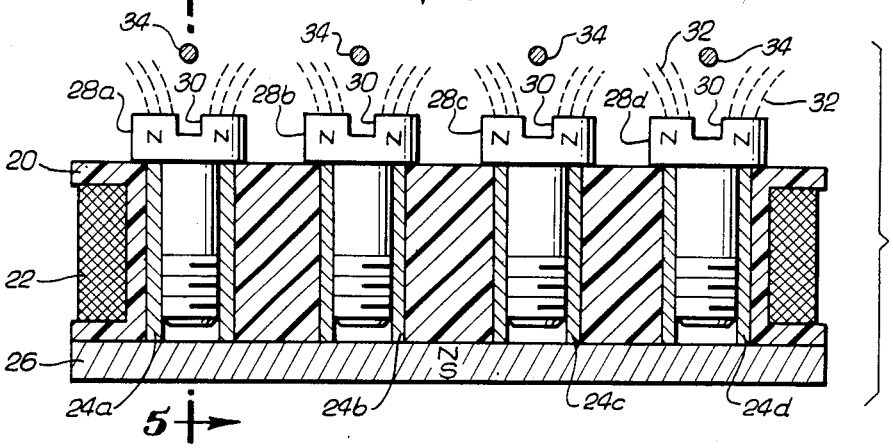
FIG. 4 is a side sectional view of the pickup of FIG. 3.

Referring to FIGS. 3, 4 and 5, a magnetic pickup assembly according to the present invention includes a plastic body section 20 having a generally elongated bobbin-shaped configuration. A coil 22 is wrapped around the body and includes output leads (not shown) for connection to an amplifying circuit. Tubular metal collars 24*a–d* are positioned in holes passing through the body sections and come into contact with a permanent magnet 26 positioned adjacent the bottom of the body 20.

The pole pieces of the magnetic pickup are comprised of screws 28*a–d* which are threaded into the collars 24*a–d*, respectively. In the present embodiment of the invention, the screws 28 are self-threading into the collars 24. The heads of the screws include slots 30, with a particular embodiment of the invention utilizing screws having a ⅜" head which is 5/32" thick and a slot which is 1/16" deep. The pole pieces are magnetically coupled to the magnet via the metal collars 24.

By providing the slots 30, the heads of the pole pieces 28 can in effect function as two separate pole pieces of the same polarity. The magnetic lines emanating from the pole pieces therefore tend to oppose each other, as indicated in FIG. 4 at 32. These magnetic flux lines from the head of the pole pieces are completed at the south pole of the magnet 26 (in the case when the north pole is connected to the collars 24).

Figure 6:
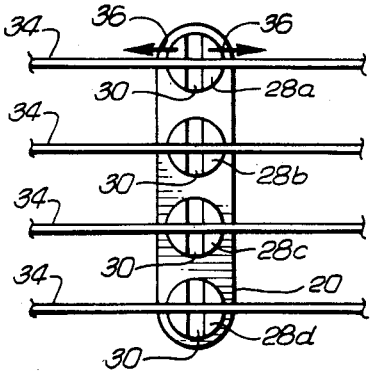
FIG. 6 is a top plan view of the pickup of the present invention showing the pole pieces oriented to obtain a percussive sound.

Because of the separation of flux lines emanating from each pole piece, the pickup can be made to operate in either a percussive or dual pole fashion. In FIG. 6, the pole pieces 28 are shown oriented so that the slots 30 are perpendicular to strings 34 which are spaced directly above the pole pieces such that each string passes through a center longitudinal axis of a corresponding pole piece (as shown in FIG. 4). When the slots are perpendicular to the strings, the pickup operates in a percussive fashion, since the flux lines emanating from the two portions of the heads do not separate to either side of a string but rather along the length of the string as indicated by arrows 36. As a result, the interaction of the magnetic flux lines with the string 34 is essentially the same as if the slot 30 were not present, i.e., a percussive effect is obtained.

Figure 1:
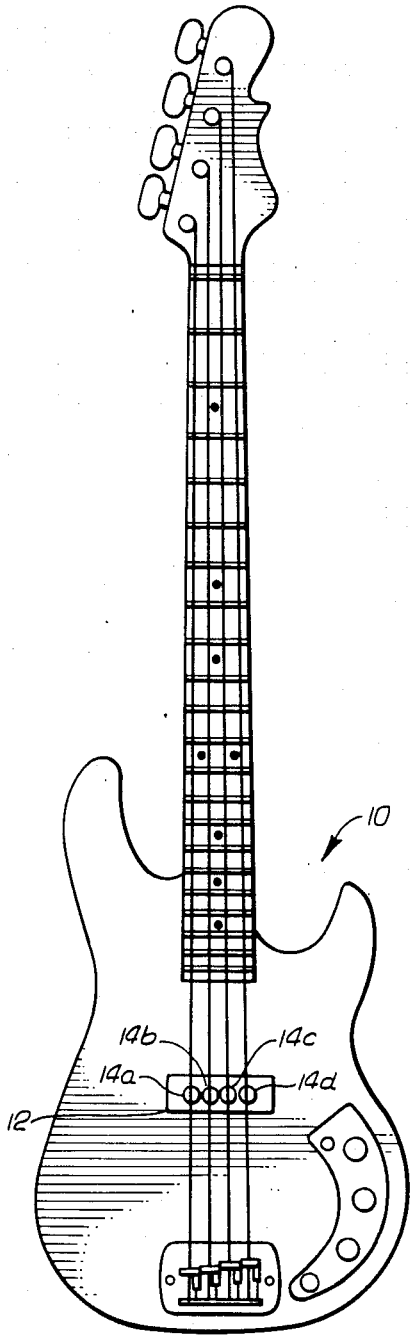
Fig. 1 PRIOR ART
FIG. 1 is a top plan view of a guitar having a percussive pickup.
Figure 2:
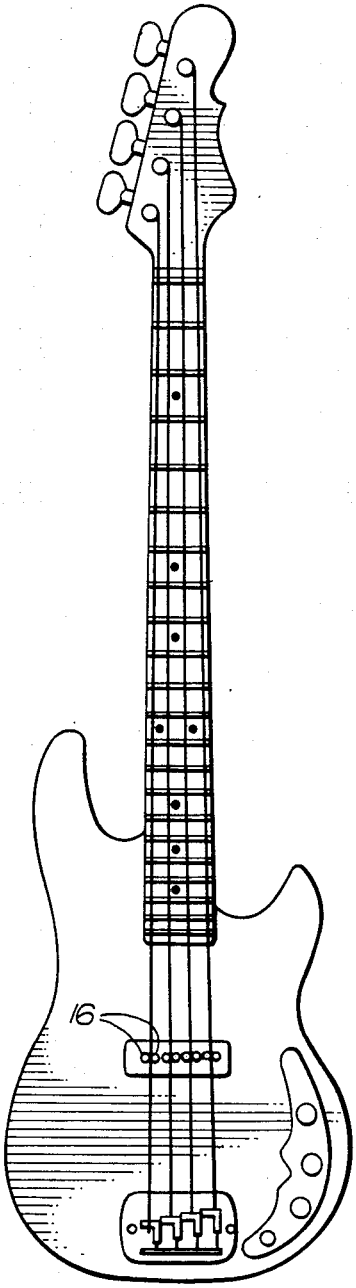
Fig. 2 PRIOR ART
FIG. 2 is a top plan view of a guitar having a dual pole pickup.
Figure 7:
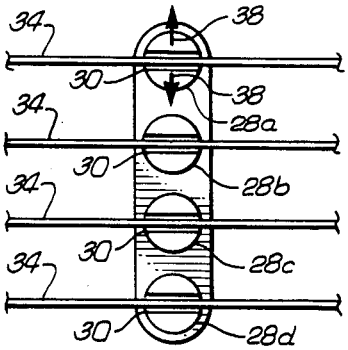
FIG. 7 is a top plan view of the pickup of the present invention showing the pole pieces oriented to obtain a dual pole sound characteristic.

By rotating the pole pieces 90° so that the slots 30 are parallel to the 34 as shown in FIG. 7, the flux lines from the two portions of each head move away from the corresponding string 34 as indicated by arrows 38. Because of this, the pickup operates as if a separate pole piece were positioned to either side of the string 34, i.e., in a fashion similar to that shown in FIG. 2. As a result, a dual pole sound characteristic will be achieved.

Thus, simply by rotating the pickup heads by 90°, the sound characteristics of the pickup may be altered to achieve either percussive or dual pole characteristics. In addition, since the pole pieces are threaded into the collars 24, their distance from the strings 34 may be easily adjusted to alter the output amplitude from the pickup.

Although the pickup has been described in a particular embodiment which includes a single pole piece for each string, the present invention may be used with many different pole piece configurations which are well known in the art. For example, the configuration may be used in a pickup of the type known as a humbucking arrangement in which two rows of pole pieces are provided perpendicular to the strings. Several different possible pickup configurations are illustrated in U.S. Pat. No. 4,220,069 to C. Leo Fender, the disclosure of which is incorporated herein by reference. Regardless of the overall pickup configuration, when the present invention is employed a pole piece will be positioned directly below each string and is rotatable so that the slot in the head of the pole piece is either perpendicular or parallel to the associated string.

What is claimed is:

1. An electrical musical instrument of the stringed type, comprising:

a body;

a neck extending from the body;

a plurality of strings extending across the body and along the neck;

an electromagnetic pickup assembly secured to the body and including (a) a plurality of pole pieces each having a first end adjacent the plane of the strings and lying directly below a string, each first end having a slot therein thereby to define a pair of pole faces, (b) coil means associated with the pole pieces and (c) a housing for supporting each pole piece for rotation about its longitudinal axis, wherein the pole pieces are rotatable to a first configuration in which each slot is parallel to its respective string to provide a first sound characteristic and a second configuration in which each slot is perpendicular to its respective string to provide a second sound characteristic.

2. An electrical musical instrument according to claim 1 wherein:

each pole piece is comprised of a magnetizable tubular element having a threaded interior and a magnetizable screw which is threaded into one of the tubular elements, said screw including a slotted head defining the first end of each pole piece; and wherein the pickup assembly further includes at least one permanent magnet contacting the end of each tubular element opposite the first end to produce a magnetic field in the tubular element and its associated screw.

3. An electrical musical insrument according to claim 2 wherein the housing is formed of molded plastic and wherein the tubular elements are secured in the housing and prevented from rotation.

4. An electrical musical instrument according to claim 1 wherein each pole pieces is a permanent magnet.

* * * * *